US005525075A

United States Patent [19]

Michisita et al.

[11] Patent Number: 5,525,075

[45] Date of Patent: Jun. 11, 1996

[54] COAXIAL MICROSTRIPLINE TRANSDUCER

[75] Inventors: Kenshi Michisita; Tomoyoshi Ohnishi; Yuichi Maruyama; Shigeki Takahashi, all of Kyoto-fu, Japan

[73] Assignee: Murata Manufacturing Co., Ltd., Japan

[21] Appl. No.: 259,675

[22] Filed: Jun. 13, 1994

Related U.S. Application Data

[63] Continuation-in-part of Ser. No. 985,189, Nov. 30, 1992, Pat. No. 5,336,112.

[51] Int. Cl.[6] ..... H01R 9/05

[52] U.S. Cl. ..... 439/581; 439/63; 439/931

[58] Field of Search ..... 439/578-585, 439/63, 931, 607, 610, 736, 886

[56] References Cited

U.S. PATENT DOCUMENTS

| | | | |
|---|---|---|---|
| 3,587,029 | 6/1971 | Knowles | 439/607 |
| 3,605,075 | 9/1971 | Stofkooper | 439/931 |
| 4,544,227 | 10/1985 | Hirose | 439/931 |
| 5,158,465 | 10/1992 | Zaderej | 439/931 |
| 5,190,474 | 3/1993 | Ginet | 439/581 |
| 5,322,453 | 6/1994 | Resnick et al. | 439/63 |

*Primary Examiner* David L. Pirlot

*Attorney, Agent, or Firm* Ostrolenk, Faber, Gerb & Soffen

[57] ABSTRACT

A coaxial microstripline transducer, having an inner conductor with a center conductor portion arranged in a recess portion of a resin case and a terminal portion which is integral with the center conductor portion and formed so as to lead to a lower surface of the resin case. An outer conductor has a first conductor portion arranged along at least a part of an inner peripheral surface of the recess portion and a second conductor portion which is integral with the first conductor portion and extended to the lower surface across an upper surface and across a pair of side surfaces opposed to each other of the resin case. The inner and outer conductors are fixed to the resin case. The outer conductor is preferably made of sheet metal material so as to enjoy low high-frequency losses. The first conductor portion advantageously is resilient and projects into the recess portion of the resin case to grip and engage a plug inserted into the transducer.

25 Claims, 12 Drawing Sheets

FIG.17
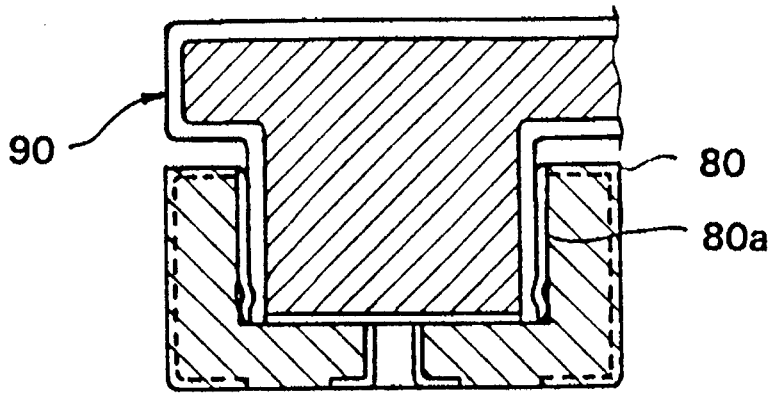
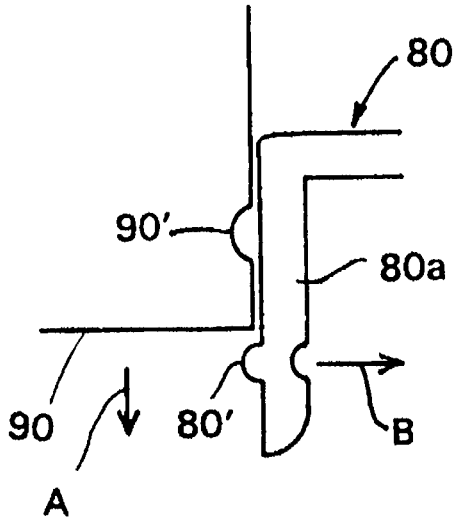
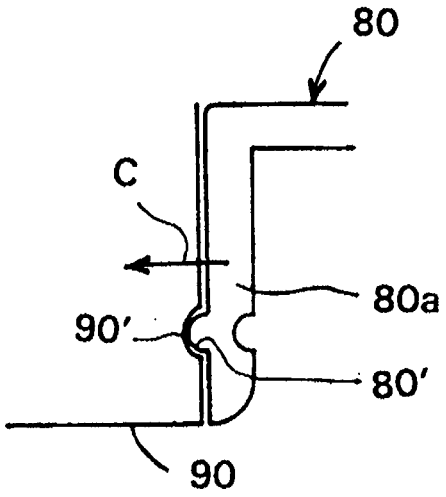
FIG.18A
FIG.18B

COAXIAL MICROSTRIPLINE TRANSDUCER

CROSS-REFERENCE TO RELATED APPLICATION

This is a continuation-in-part of Ser. No. 07/985,189, filed Nov. 30, 1992, U.S. Pat. No. 5,336,112.

BACKGROUND OF THE INVENTION

1. Field of the Invention

The present invention relates generally to a coaxial microstripline transducer for use as, for example, a coaxial connector, and more particularly, to a coaxial microstripline transducer comprising an inner conductor having a center conductor portion arranged in a recess portion which opens upward, and an outer conductor arranged apart from the center conductor portion.

2. Description of the Prior Art

A coaxial microstripline transducer shown in FIGS. 12 to 15 has been conventionally known. FIG. 12 is a plan view illustrating a coaxial microstripline transducer, FIGS. 13 and 14 are respectively a cross-sectional view taken along a line V—V shown in FIG. 12 and a cross-sectional view taken along a line VI—VI shown in FIG. 12, and FIG. 15 is a bottom view illustrating the coaxial microstripline transducer.

In this coaxial microstripline transducer, a cylindrical recess portion 71*a* which opens upward is formed in a resin case 71 made of insulating resin. In the recess portion 71*a* are a center conductor portion 72 having a cylindrical shape made of a metal material and a first conductor portion 73 in the shape of a part of a cylindrical curved surface. A lower end of the center conductor portion 72 is connected to a terminal portion 74 made of a metal material. The terminal portion 74 is formed so as to lead to a lower surface via a side surface of the resin case 71 in order to connect the microstripline transducer to a connecting land (not shown) on a substrate. That is, the center conductor portion 72 and the terminal portion 74 constitute an inner conductor of the microstripline transducer.

On the other hand, the first conductor portion 73 is connected to a second conductor portion 75. The second conductor portion 75 is formed so as to lead to the lower surface via the side surface of the resin case 71 in order to connect the microstripline transducer to a connecting land (not shown) on the substrate. The first conductor portion 73 and the second conductor portion 75 constitute an outer conductor of the microstripline transducer. In addition, embedded metal parts 76 are formed on the lower surface of the resin case 71 in order to increase stability and bond strength, when the microstripline transducer is mounted on a substrate or the like.

The above-described inner conductor and outer conductor are respectively formed by working a metal plate or a metal wire in accordance with a working method such as press working. The above-described coaxial microstripline transducer is constructed by mounting the metal members on the resin case 71 which is a molded resin product.

In the above-described microstripline transducer, the outer conductor comprising the first conductor portion 73 and the second conductor portion 75 are incorporated into the resin case 71 and the second conductor portion 75 is folded along the lower surface of the resin case 71. However, such an assembly operation is very difficult because the resin case 71 is small. That is, the plane dimensions of the resin case 71 are small, approximately 4 mm×4.5 mm, for example, so that the operation which includes passing the outer conductor having a complicated shape from the inside of the recess portion 71*a* to the outer side surface of the resin case 71 and further pulling the same out to the lower surface of the resin case 71 is very difficult. Particularly, there is a strong demand for miniaturization of the microstripline transducer, as with other electronic components. However, the smaller the dimensions of the microstripline transducer are, the more difficult the above described assembly operation is. Consequently, the manufacturing processes are complicated, and the manufacturing cost is increased.

Furthermore, in the above-described coaxial microstripline transducer, the terminal portion 74 of the inner conductor, the second conductor portion 75 of the outer conductor, and the embedded metal parts 76, which are arranged on the lower surface of the resin case 71, as shown in FIG. 15, are relatively small. The terminal portion 74, the second conductor portion 75, and the embedded metal parts 76 are soldered to a wiring pattern or to connecting lands on the substrate, to mount the microstripline transducer on the substrate. Because the base areas of the terminal portion 74, the second conductor portion 75, and the embedded metal parts 76 are relatively small, sufficient soldering strength (mounting strength) cannot be obtained.

It has been suggested to increase the areas of the parts located on the lower surface of the resin case 71, namely the terminal portion 74, the second conductor portion 75, and the embedded metal parts 76, to thereby increase the soldering strength. However, an attempt to increase the soldering areas causes a heavy load to be applied to the resin case 71 in folding the terminal portion 74 and the second conductor portion 75 along the resin case 71, resulting in the possibility of damaging the resin case 71. Consequently, the soldering areas of the terminal portion 74, the second conductor portion 75, and the embedded metal parts 76 cannot be greatly increased in size.

Additionally, as shown in FIG. 13, the inner conductor, comprising the center conductor portion 72 and the terminal portion 74, is mounted on the resin case 71 by insert molding. However, the terminal portion 74 is folded along the side surface and the lower surface of the resin case 71 after the insert molding. Consequently, there is a limit on the amount the thicknesses T1 and T2 (see FIG. 13) of bottom parts of the resin case 71 can be decreased, so that the products are prevented from being reduced in height.

SUMMARY OF THE INVENTION

An object of the present invention is to overcome the above-described disadvantages of the conventional coaxial microstripline transducer and to provide a coaxial microstripline transducer which is easy to manufacture, can be increased in soldering strength (mounting strength) when mounted on a substrate or the like, and is easy to miniaturize.

In accordance with a broad aspect of the present invention, there is provided a coaxial microstripline transducer comprising a resin case having a recess portion which opens upward; an inner conductor which includes a center conductor portion arranged in the recess portion and a terminal portion which is integral with the center conductor portion and formed so as to lead to a lower surface of the resin case; and an outer conductor which includes a first conductor portion arranged along at least part of an inner peripheral surface of the recess portion and a second conductor portion which is integral with the first conductor portion and extends to the lower surface across an upper surface and across at least one side surface, or a pair of side surfaces of the resin case which are opposed to each other.

According to a highly advantageous feature of the invention, the outer conductor is made of sheet metal material so as to enjoy low high-frequency losses. The sheet metal material is preferably shaped by machining so as to decrease manufacturing costs, and further, the use of sheet metal enhances the stability of coupling the first conductor portion with a plug.

According to another highly advantageous feature, the first conductor portion may be made resilient so as to deflect inwardly into the recess portion so as to engage and grip a plug inserted therein.

In accordance with a particular aspect of the present invention, there is provided a coaxial microstripline transducer in which a through hole is formed in a bottom surface of the recess portion leading to the lower surface of the resin case; the center conductor portion of the above-described inner conductor is inserted so as to extend into the recess portion from the through hole; and the above described terminal portion is formed integrally with the center conductor portion on the lower surface of the resin case and formed so as to lead to at least one side surface, or a pair of side surfaces opposed to each other from the lower surface of the resin case.

Furthermore, in accordance with a second broad aspect of the present invention, there is provided a coaxial microstripline transducer comprising a resin case having a recess portion opened upward, an inner conductor having a center conductor portion arranged in the recess portion and a terminal portion formed integrally with the center conductor portion and formed so as to lead to a lower surface of the resin case, and an outer conductor having a first conductor portion arranged along at least a part of an inner peripheral surface of the recess portion and a second conductor portion formed integrally with the first conductor portion and extended to the lower surface across an upper surface and across a pair of side surfaces opposed to each other of the resin case; the terminal portion of the above described inner conductor having at least one narrow portion having a width relatively smaller than that of the remainder of the terminal portion.

In the coaxial microstripline transducer according to the present invention, the center conductor portion may be arranged in the recess portion of the resin case, and the outer conductor may be arranged so as to lead to the lower surface across the upper surface and across the pair of side surfaces opposed to each other of the resin case from the inside of the recess portion, as described above. Accordingly, the outer conductor can be easily incorporated into the resin case by fitting the outer conductor to the resin case. Consequently, it is possible to simplify the manufacturing processes and reduce the manufacturing cost of the coaxial microstripline transducer.

Furthermore, since the outer conductor has the above-described shape, a capacitance component created between the center conductor portion and the first conductor portion of the outer conductor can be canceled by an inductance component created by the shape of the outer conductor, thereby to make it possible to reduce or prevent impedance mismatching.

Additionally, in the above-described structure in which the center conductor portion is inserted through the through hole into the recess portion from the lower surface of the resin case, it is easy to incorporate the center conductor portion into the resin case. Accordingly, it is possible to further simplify the manufacturing processes and reduce the manufacturing cost of the microstripline transducer.

Moreover, in accordance with the above described second broad aspect of the present invention, the narrow portion is provided in the terminal portion of the inner conductor, so that a capacitance component created in the microstripline transducer is compensated for by an inductance component created in the narrow portion. Consequently, it is possible not only to simplify the manufacturing processes and reduce the manufacturing cost of the coaxial microstripline transducer but also to partially or completely prevent the characteristic impedance from being lowered, thereby allowing impedance matching to be enhanced. Accordingly, a coaxial microstripline transducer can be provided that is low in energy reflection and therefore low in voltage standing-wave ratio.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 17 is a cross-sectional view of the plug and transducer of FIG. 16; and FIGS. 18A and 18B show two stages in the process of inserting the plug into the transducer.

DESCRIPTION OF THE PREFERRED EMBODIMENTS

Figure 1:
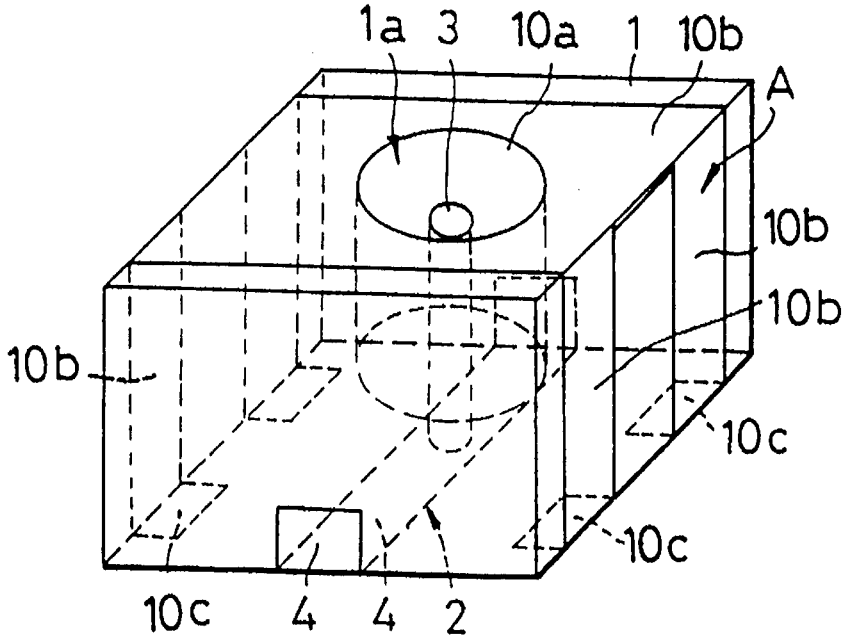
FIG. 1 is a perspective view illustrating a coaxial microstripline transducer according to a first embodiment of the present invention.
Figure 2:
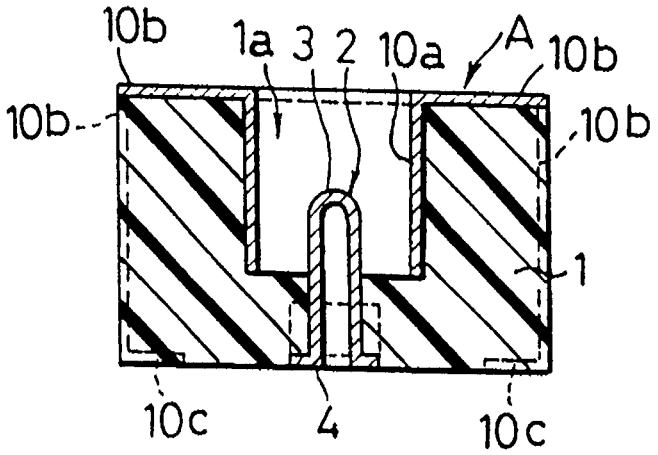
FIG. 2 is a cross-sectional view illustrating a coaxial microstripline transducer according to the first embodiment.

FIG. 1 is a perspective view illustrating a coaxial microstripline transducer according to a first embodiment of the present invention, and FIG. 2 is a cross sectional view thereof. As shown in FIGS. 1 and 2, in the coaxial microstripline transducer according to the present invention, a recess portion la which opens upward is formed in a resin case 1 made of insulating resin. A center conductor portion 3 of an inner conductor 2 is inserted in the recess portion la. The inner conductor 2 includes the center conductor portion 3, composed of a cylindrical conductor, and a terminal portion 4 which is integral with a lower end of the center conductor portion 3. The terminal portion 4 is formed so as to lead to a pair of side surfaces opposed to each other from a lower surface of the resin case 1.

Furthermore, an outer conductor A is mounted on the resin case 1. The outer conductor A is constructed by integrally forming a first conductor portion 10*a* in a cylindrical shape, a second conductor portion comprising a bridge portion 10*b*, and a terminal portion 10*c*, as shown in FIG. 2. The first conductor portion 10*a* is arranged along the whole inner peripheral surface of the recess portion la of the resin case 1. On the other hand, the second conductor portion is constructed by integrally forming (1) the bridge portion 10*b* which extends from an upper surface of the resin case 1 to the lower surface via a pair of side surfaces opposed to each other, and (2) the terminal portion 10*c* formed along the lower surface of the resin case 1.

The outer conductor A is formed in a shape as shown and is fixed to the resin case 1 by the steps of: previously fabricating a conductor member with the bridge portion 10*b* and the terminal portion 10*c* not folded, by a method, for example, such as machining or press working; mounting the member on the resin case 1; and folding the member along the outer surface of the resin case by pressing using a mold (not shown).

Figure 3:
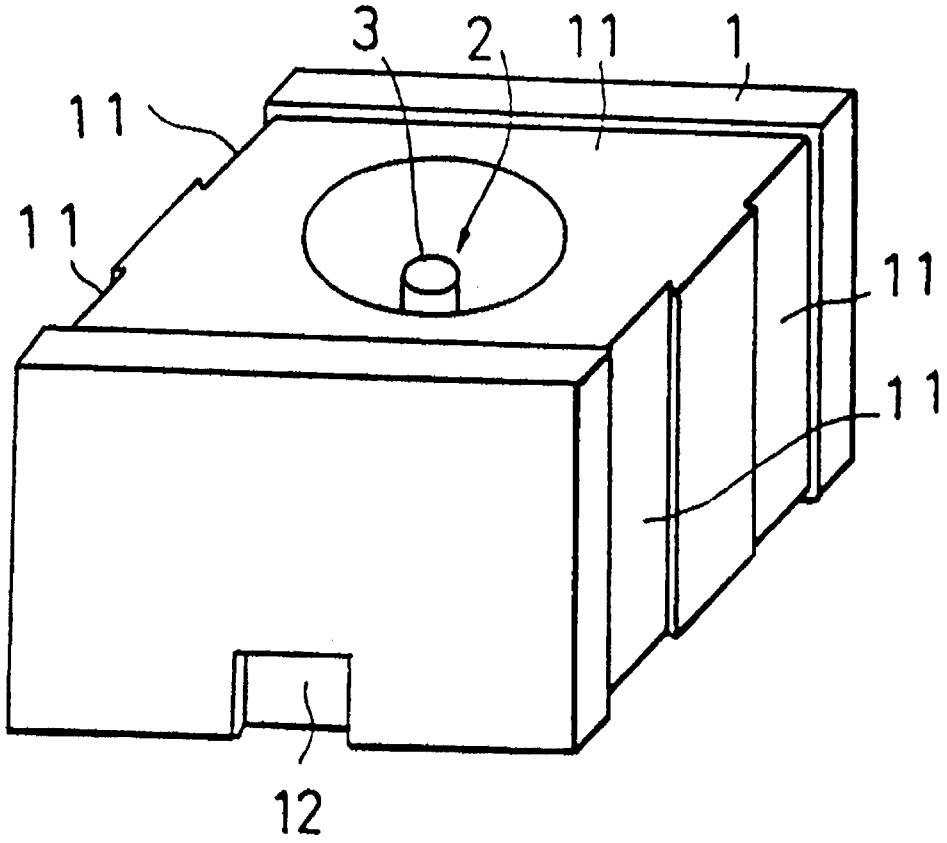
FIG. 3 is a perspective view illustrating a resin case of a coaxial microstripline transducer according to the first embodiment.

As shown in FIG. 3, a groove 11 having a shape corresponding to the shape of the above described outer conductor A and a groove 12 having a shape corresponding to the shape of the terminal portion 4 of the inner conductor 2 are formed on the outer surface of the resin case 1. The outer conductor A is fitted in the groove 11, and the terminal portion 4 is fitted in the groove 12. The depths of the grooves 11 and 12 are respectively selected so that the outer conductor A and the terminal portion 4 do not project outward from the outer surface of the resin case 1 when the outer conductor A and the terminal portion 4 are fitted on the resin case 1. Consequently, when the outer conductor A and the terminal portion 4 are fixed to the resin case 1, the external dimensions of the microstripline transducer are not increased. That is, since the above described grooves 11 and 12 are provided, the microstripline transducer is not prevented from being miniaturized and reduced in height.

In the coaxial microstripline transducer according to the present embodiment, the outer conductor A is composed of a conductor member constructed so as to lead to the lower surface via the upper surface and the pair of side surfaces opposed to each other from the inner peripheral surface of the recess portion 1*a* of the resin case 1, and is mounted on the resin case 1 by pressing using a mold. Accordingly, it is easy to assemble the coaxial microstripline transducer, thereby to simplify the manufacturing process thereof. Consequently, it is possible to effectively reduce the manufacturing cost of the coaxial microstripline transducer.

Furthermore, in the coaxial microstripline transducer according to the-present embodiment, as a result of the above-described shape of the outer conductor A, an inductance component created by that shape cancels a capacitance component created between the outer conductor A and the center conductor portion 3 of the inner conductor 2. In the microstripline transducer according to the present embodiment, therefore, impedance mismatching is effectively restrained, reflection is reduced, and the electrical properties are enhanced as compared with the conventional coaxial microstripline transducer.

Additionally, the above-described coaxial microstripline transducer is constructed so that the outer conductor A is fitted in the groove 11 formed in the resin case 1. Accordingly, the external dimensions and the height of the whole microstripline transducer are not increased, although the outer conductor A is arranged along the outer side surface of the resin case 1. In addition, the terminal portion 4 of the inner conductor 2 is contained in the groove 12. Accordingly, the terminal portion 4 similarly does not project outward from the outer surface of the resin case 1. Therefore, the external dimensions and the height of the coaxial microstripline transducer are not increased, which also facilitates the miniaturization of the microstripline transducer.

In the present embodiment, an example is illustrated in which the bridge portion lob and the terminal portion 10*c* constituting the second conductor portion of the outer conductor A are formed into two branches, mainly to correspond to a wiring pattern such as a connecting land on a substrate. Consequently, the shape of the outer conductor A, including a part of the bridge portion 10*b* which is located on the upper surface of the resin case 1, may be changed to another different shape depending on the intended conditions of use.

Figure 4:
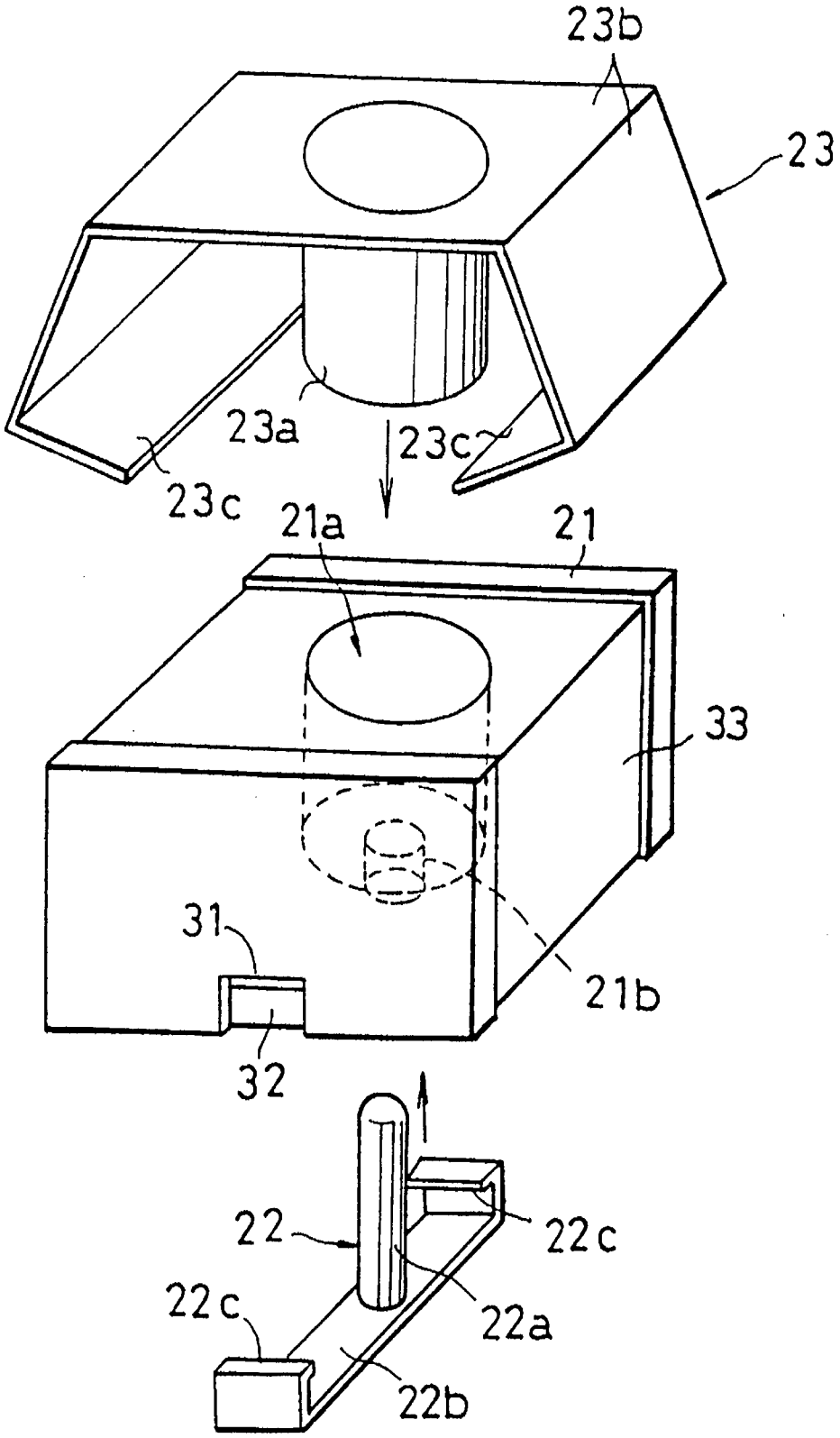
FIG. 4 is an exploded perspective view for explaining a coaxial microstripline transducer according to a second embodiment.
Figure 5:
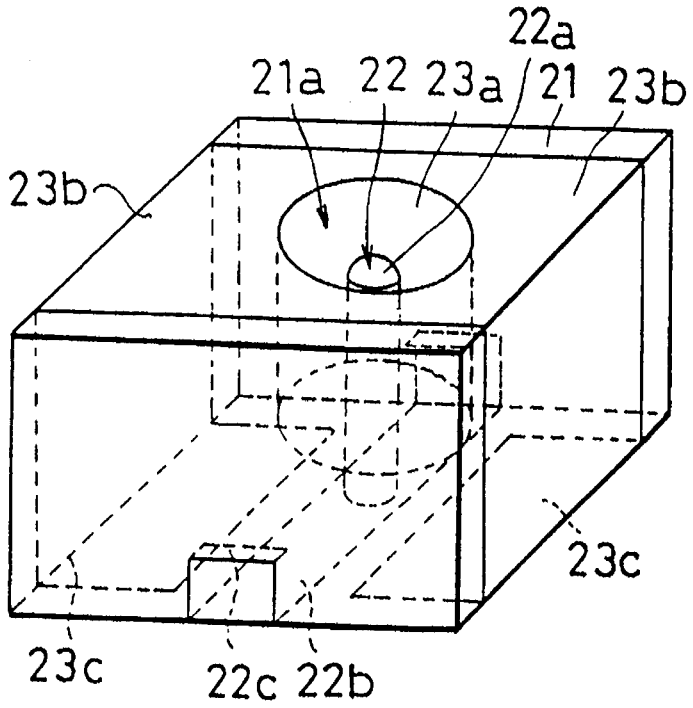
FIG. 5 is a perspective view illustrating the coaxial microstripline transducer according to the second embodiment.
Figure 6:
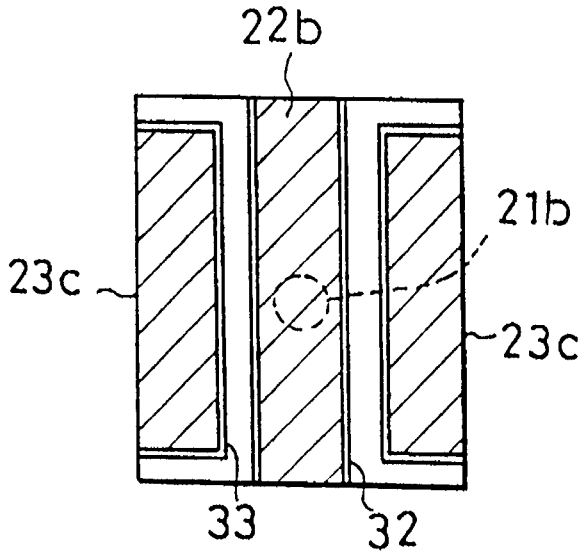
FIG. 6 is a bottom view illustrating the coaxial microstripline transducer according to the second embodiment.

FIG. 4 is an exploded perspective view illustrating a coaxial microstripline transducer according to a second embodiment of the present invention. FIGS. 5 and 6 are respectively a perspective view and a bottom view illustrating the coaxial microstripline transducer according to the second embodiment.

As shown in FIGS. 4 and 5, in the coaxial microstripline transducer according to the second embodiment, a recess portion 21*a* which opens upward is formed in a resin case 21, as in the first embodiment. However, a through hole 21*b* leading to a lower surface of the resin case 21 is formed in a bottom surface of the recess portion 21*a*. The through hole 21*b* is provided so as to insert a center conductor portion 22*a* of an inner conductor 22 shown in the lower part of FIG. 4 into the recess portion 21*a*. The inner conductor 22 comprises the center conductor portion 22*a* which has a cylindrical shape, a terminal portion 22*b* which is integral with a lower end of the center conductor portion 22*a*, and which extends in the horizontal direction and folds upward at its ends, and ends 22*c* which are folded toward the center conductor portion 22*a* at the upper ends of the upward-folded parts of the terminal portion 22*b*.

A groove 32 in which the terminal portion 22*b* of the above described inner conductor 22 is fitted, is formed on the lower surface and a pair of side surfaces opposed to each other of the resin case 21. An engaging hole 31 is formed at an upper end of the groove 32 on each of the pair of side surfaces opposed to each other of the resin case 21. Thus, the above described ends 22*c* can be fitted securely into the engaging holes 31.

The above described inner conductor 22 is fixed to the resin case 21 by inserting the center conductor portion 22*a* into the through hole 21*b* from below the resin case 21 and snapping the ends 22*c* at the ends of the terminal portion 22*b* into the engaging holes 31.

On the other hand, an outer conductor 23 is mounted on the resin case 21 from above the resin case 21. The outer conductor 23 comprises a cylindrical portion 23*a* which fits along an inner peripheral surface of the recess portion 21*a*, a bridge portion 23*b* which is integral with an upper end of the cylindrical portion 23*a* and leads across the upper surface and a pair of side surfaces opposed to each other of the resin case 21, and terminal portions 23*c* located on the lower surface of the resin case 21. In addition, the widths of the bridge portion 23*b* and the terminal portions 23*c* are made approximately equal to or slightly smaller than the width of the resin case 21. That is, the bridge portion 23*b* and the terminal portions 23*c* are formed so as to have a width relatively larger than that of the terminal portion in the outer conductor A of the first embodiment.

The resin case 21 is provided with a groove 33 in which the bridge portion 23*b* and the terminal portions 23*c* in the above described outer conductor 23 can be fitted. The outer conductor 23 is mounted on the resin case 21 by the steps of: previously preparing a conductive member with the bridge portion 23*b*; bending the terminal portions 23*c* and the rest to some extent by a method, for example, such as press working; and then fitting and fixing the member to the resin case 21. Consequently, the outer conductor 23 can be reliably engaged with the resin case 21 without applying high stress to the resin case 21.

As can be seen from FIGS. 5 and 6, the terminal portions 23*c* of the above described outer conductor 23 lead to positions close to the terminal portion 22*b* of the inner conductor 22 on the lower surface of the resin case 21, so that the area of the terminal portions 23*c* is very large.

Alternatively, outer conductor 23 may be formed in a predetermined shape and at the same time, fixed to the resin case 21 by the steps of: fabricating an outer conductor member with the terminal portions 23*c* not being folded, engaging the member with the resin case 21, and then, folding the member along the outer surface of the resin case 21 by pressing using a mold, depending on the shape, the strength and the like of the resin case 21.

In the coaxial microstripline transducer according to the second embodiment, as in the first embodiment, it is easy to mount the outer conductor 23 on the resin case 21 by fitting the outer conductor 23 to the resin case 21 as described above. Further, the second embodiment further simplifies the manufacturing process and reduces the manufacturing cost, as compared with the first embodiment, in that the inner conductor 22, in which the center conductor portion 22*a* and the terminal portion 22*b* are integrally formed in a predetermined shape, can be easily mounted on the resin case 21 by fitting the inner conductor 22 to the resin case 21, and snapping the terminal portions 22*c* into the engaging holes 31.

Furthermore, in the coaxial microstripline transducer according to the second embodiment, the terminal portion 22*b* in the inner conductor 22 leads onto the pair of side surfaces opposed to each other from the lower surface of the resin case 22, and the portion extending from one of the pair of side surfaces to the other side surface is used as a soldering portion. Another soldering portion is a wide portion, having a large area, which leads to the lower surface of the resin case 21, of the outer conductor 23. As also apparent from FIG. 6, therefore, the soldering area is very large as a whole, thereby making it possible to increase the soldering strength, that is, the mounting strength on the substrate or the like.

Furthermore, in the coaxial microstripline transducer according to the second embodiment, the outer conductor 23 is fitted in the above described groove 33. Accordingly, when the outer conductor 23 is mounted, the external dimensions and the height of the coaxial microstripline transducer are not increased. Similarly, the terminal portion 22*b* of the inner conductor 22 is fitted in the groove 32 so that it does not project outward from the outer surface of the resin case 21. Consequently, the coaxial microstripline transducer is not prevented from being miniaturized, like the coaxial microstripline transducer according to the first embodiment.

According to the above described first and second embodiments, in respectively fixing the outer conductors A and 23 to the resin cases 1 and 21, the outer conductors A and 23 are hot-pressed against the resin cases 1 and 21 or bonded thereto by applying heat. Accordingly, the mounting strength of the outer conductors A and 23 can be increased, thereby making it possible to further increase the reliability.

Additionally, although in the first and second embodiments, the cylindrical portions 10*a* and 23*a* of the outer conductors A and 23 are respectively formed in cylindrical shapes corresponding to the inner peripheral surfaces of the recess portions la and 21*a* of the resin cases 1 and 21, they need not be necessarily formed in shapes which cover the whole inner peripheral surfaces of the recess portions 1*a* and 21*a*. That is, the above described cylindrical portions 10*a* and 23*a* may be replaced with a member in the shape of a cylindrical curved surface which only extends along part of the recess portions 1*a* and 21*a*.

Furthermore, in the microstripline transducers according to the first and second embodiments, the shapes of the resin cases 1 and 21, the center conductor portions 3 and 22*a*, the terminal portions 4 and 22*b* which extend from the center conductor portions 3 and 22*a*, and the like, are not limited to having the same shapes as those in the embodiments shown. They may be deformed or modified into various other shapes within a range in which the objects of the present invention are still attained.

Moreover, embedded metal parts may be formed on the lower surfaces of the resin cases 1 and 21 so as to ensure stability and strength when the microstripline transducers are mounted on substrates or the like, although they are not shown above in connection with the microstripline transducers according to the first and second embodiments.

Figure 7:
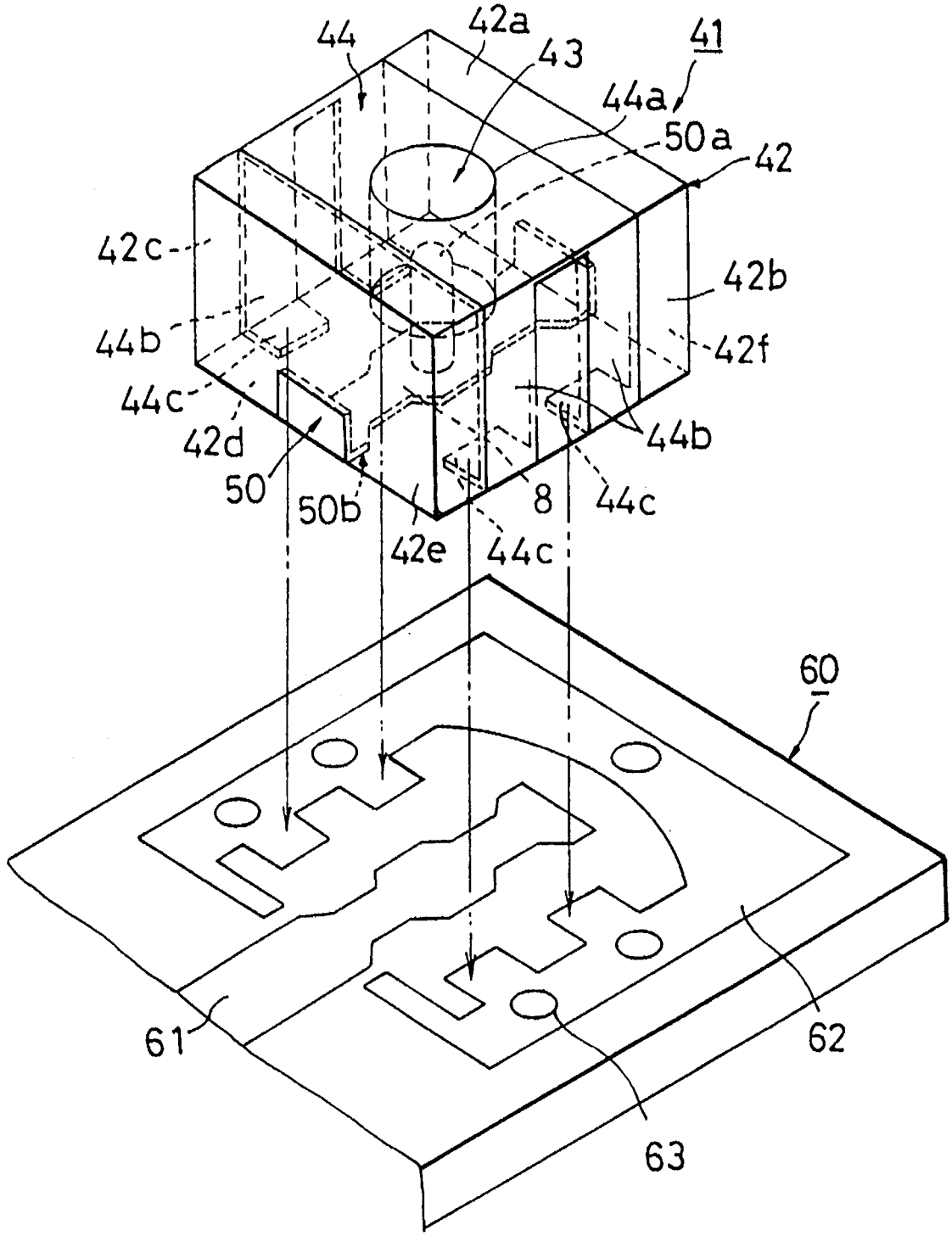
FIG. 7 is a perspective view for explaining a coaxial microstripline transducer according to a third embodiment.
Figure 8:
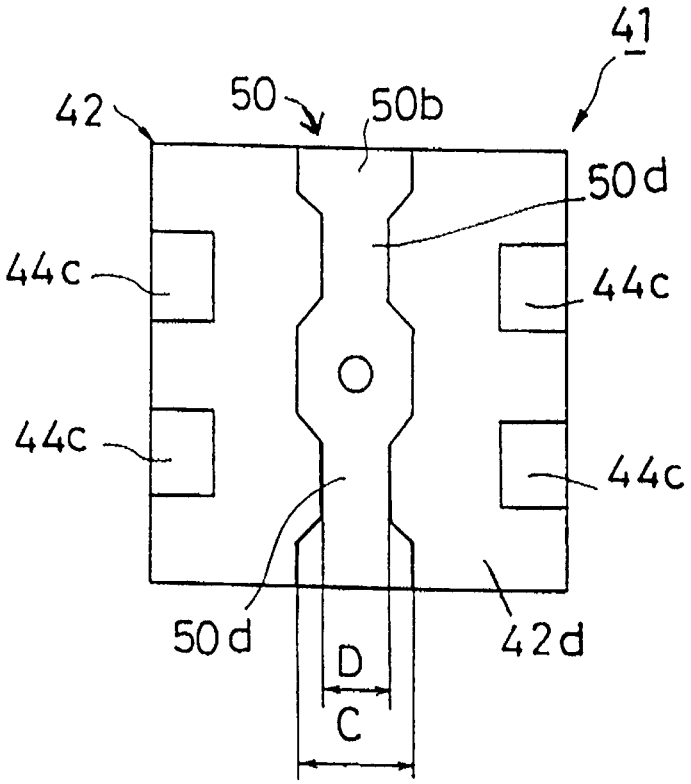
FIG. 8 is a bottom view illustrating the coaxial microstripline transducer according to the third embodiment.

FIGS. 7 and 8 are respectively a perspective view and a plan view for explaining a coaxial microstripline transducer according to a third embodiment of the present invention.

The basic construction of the coaxial microstripline transducer 41 of the third embodiment is the same as that of the first embodiment. Consequently, the description of common similar portions is omitted, by incorporating the description of the first embodiment.

The coaxial microstripline transducer 41 according to the present embodiment has a resin case 42 having a roughly cubic or parallelepiped shape. A recess portion 43 opened toward an upper surface 42*a* is formed in the resin case 42. An outer conductor 44 and an inner conductor 50 are mounted on the resin case 42, as in the first embodiment.

More specifically, the outer conductor 44 mounted from above the upper surface 42*a* of the resin case 42 comprises a cylindrical portion 44*a* formed along an inner peripheral surface of the recess portion 43, a bridge portion 44*b* which is integral with an upper end of the cylindrical portion 44*a* and extended so as to lead across a pair of side surfaces 42*b* and 42*c* opposed to each other from the upper surface 42*a* of the resin case 41, and terminal portions 44*c* which extend from the side surfaces 42*b*, 42*c* onto a lower surface 42*d* of the resin case 41. The above-described bridge portion 44*b* forms branches on the side surfaces of the resin case 41, and the terminal portions 44*c* leading to the lower surface of the resin case 41 are respectively formed as the end portions of these branches.

The above-described outer conductor 44 can be mounted on the resin case 41, in the same manner as in the first and second embodiments. Further, also in the present embodiment, a groove is formed on the outer surface of the resin case 41 in conformity with the shape of the outer conductor 44, and the bridge portion 44*b* and the terminal portions 44*c* in the outer conductor 44 are fitted in the groove, so that the outer conductor 44 does not project outward from the surface of the resin case 41 when the outer conductor 44 is mounted.

On the other hand, the inner conductor 50 is mounted on the lower surface of the resin case 41. The inner conductor 50 comprises a center conductor portion 50*a* inserted in the recess portion 43 and a terminal portion 50*b* which is integral with a lower end of the center conductor portion 50*a*. Both ends of the terminal portion 50*b* are respectively folded upward so as to extend across a pair of side surfaces 42*e* and 42*f* opposed to each other of the resin case 41. The inner conductor 50 is also fitted in a groove formed on the outer surface of the resin case 41 so that its outer surface does not project outward from the outer surface of the resin case 41 when it is mounted on the resin case 41.

Also in the coaxial microstripline transducer 41 according to the present embodiment, therefore, the external dimensions and the height thereof are not increased when the outer conductor 44 and the inner conductor 50 are mounted, thereby making it possible to miniaturize of the coaxial microstripline transducer.

Furthermore, the outer conductor 44 and the inner conductor 50 can be mounted in the same manner as in the first and second embodiments, thereby making it possible to simplify the manufacturing processes and reduce the manufacturing cost of the coaxial microstripline transducer. Also, it is possible to increase the mounting strength on the substrate as in the first and second embodiments.

In FIG. 7, reference numeral 60 denotes a microstripline to which the coaxial microstripline transducer 41 according to the present embodiment is connected. A hot line 61 and a ground line 62 are formed in the microstripline 60. In addition, reference numeral 63 denotes a through hole. The through hole 63 is connected to a ground line (not shown) on the reverse surface by a conductor (not shown) formed on an inner peripheral surface of the through hole.

A description will now be made of the characteristic construction of the microstripline transducer 41 according to the third embodiment. As shown in a bottom view in FIG. 8, the inner conductor 50 has narrow portions 50*d* of the terminal portion 50*b* having a relatively small width. That is, the inner conductor 50 is constructed so that the narrow portions 50*d* have a width D as shown, while another portion other than the narrow portions 50*d* has a width C as shown. In the present embodiment, the narrow portions 50*d* are provided, so that an inductance constituent is created in the narrow portions 50*d*, and stray capacitance F produced inside of the coaxial microstripline transducer 41 is compensated for by the inductance constituent, to help to prevent variation in the characteristic impedance. This will be described in more detail.

Figure 9:
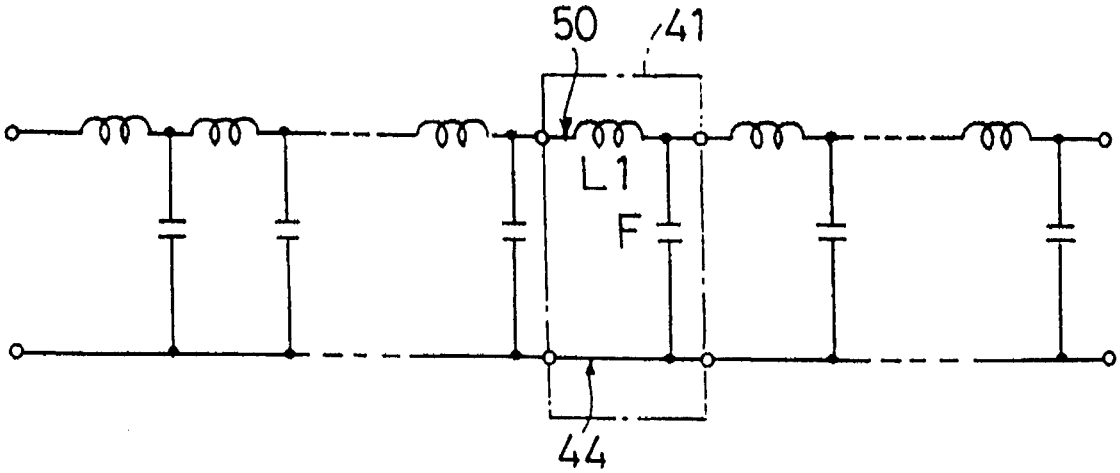
FIG. 9 is a diagram showing an equivalent circuit of a transmission network to which the coaxial microstripline transducer according to the third embodiment is connected.

In the coaxial microstripline transducer 41 according to the present embodiment, if a high-frequency signal is incident thereon, a stray capacitance F is produced between the outer conductor 44 and the inner conductor 50. This stray capacitance F forms a parallel capacitance in a circuit, as shown in the equivalent circuit diagram in FIG. 9. Consequently, the inherent capacitance is increased, whereby, in addition, the characteristic impedance in the microstripline transducer 41 is decreased.

More specifically, the characteristic impedance $Z_0$ generally is a function of (L/C). In the above described relationship, $Z_0$ denotes the characteristic impedance, L denotes an inductance value per unit length, and C denotes a capacitance value per unit length. In the equation, if the capacitance value C is increased due to the production of the stray capacitance F, the characteristic impedance $Z_0$ is decreased by the amount of increase. That is, the characteristic impedance at a point where the coaxial microstripline transducer 41 is inserted is smaller than the characteristic impedance in a transmission network (generally, 50 Ω).

In the present embodiment, however, the terminal portion 50*b* in the above-described inner conductor 50 is provided with the narrow portions 50*d*. Consequently, if a high-frequency signal is incident, an inductance L1 arises in the narrow portions 50*d*. This inductance L1 is connected in series in a transmission network, so that the inductance value L in the above described equation is increased. The amount of increase in the inductance value cancels the amount of increase in the capacitance value due to the stray capacitance F. Consequently, the characteristic impedance $Z_0$ is not decreased. That is, the stray capacitance F is compensated for by the inductance L1 arising in the narrow portions 50*d*, so that the characteristic impedance $Z_0$ in the microstripline transducer 41 is prevented from being decreased, thereby maintaining impedance matching with the transmission network.

Meanwhile, the stray capacitance F produced in the microstripline transducer 41 subtly varies depending on the shape of the resin case 42, the dielectric constant, and the shapes of the outer conductor 44 and the inner conductor 50. Consequently, the shape and the number of narrow portions 50*d* for compensating for the stray capacitance F may be changed depending on the above-described various conditions. That is, although in the above described embodiment, a total of two narrow portions 50*d* are formed, the number of narrow portions 50*d* may be increased or decreased depending on the value of the stray capacitance F produced. In addition, the whole outer conductor 50 may be formed as a narrow portion 50*d* by making the whole width of the outer conductor 50 smaller than a predetermined width.

The characteristic impedance in a transmission network is usually defined by the equation $$Z_0 = \sqrt{L/C} \quad \text{(generally 50 Ω)}$$

Stray capacitance ΔC is generated in the transducer and thus the capacitance becomes C+ΔC. The characteristic impedance is thereby lowered to $$Z=\sqrt{L/(C+\Delta C)}$$

Accordingly, the characteristic impedance of the transducer becomes lower than the impedance $$Z=\sqrt{L/C}\ \text{, or } 50\,\Omega$$

in the transmission network. As a result, losses due to reflection are increased as a result of impedance mismatching.

With the present invention, such losses due to impedance mismatching can be decreased by providing the inductance ΔL, which is provided by a high-impedance portion (a narrower portion) of the outer conductor. The characteristic impedance of such transducer then becomes $$Z=\sqrt{(L+\Delta L)/(C+\Delta C)}\quad (=50\,\Omega)$$

If the impedance of the high-impedance portion is ZL, the inductance ΔL is $$\Delta L=ZL/1\tau f.\tan\,(2\tau n\ f/C_0.1e)$$

(in this equation, f:frequency, $C_0$:light velocity, and 1e:electric length of the high impedance portion).

The value of the stray capacitance AC, however, varies widely because it depends on the structure and shape of the transducer and the portion where it is generated. Thus, it is not possible to design the high-impedance portion according to a general equation.

Thus, the above-mentioned "predetermined width" will depend on the size and shape of the transducer. Nevertheless, it will be within the capacity of the individual having the ordinary level of skill in the pertinent art, given the present disclosure, to design a transducer as just explained, having inner and outer conductors shaped so that stray capacitance is cancelled by an additional inductance.

Figure 10:
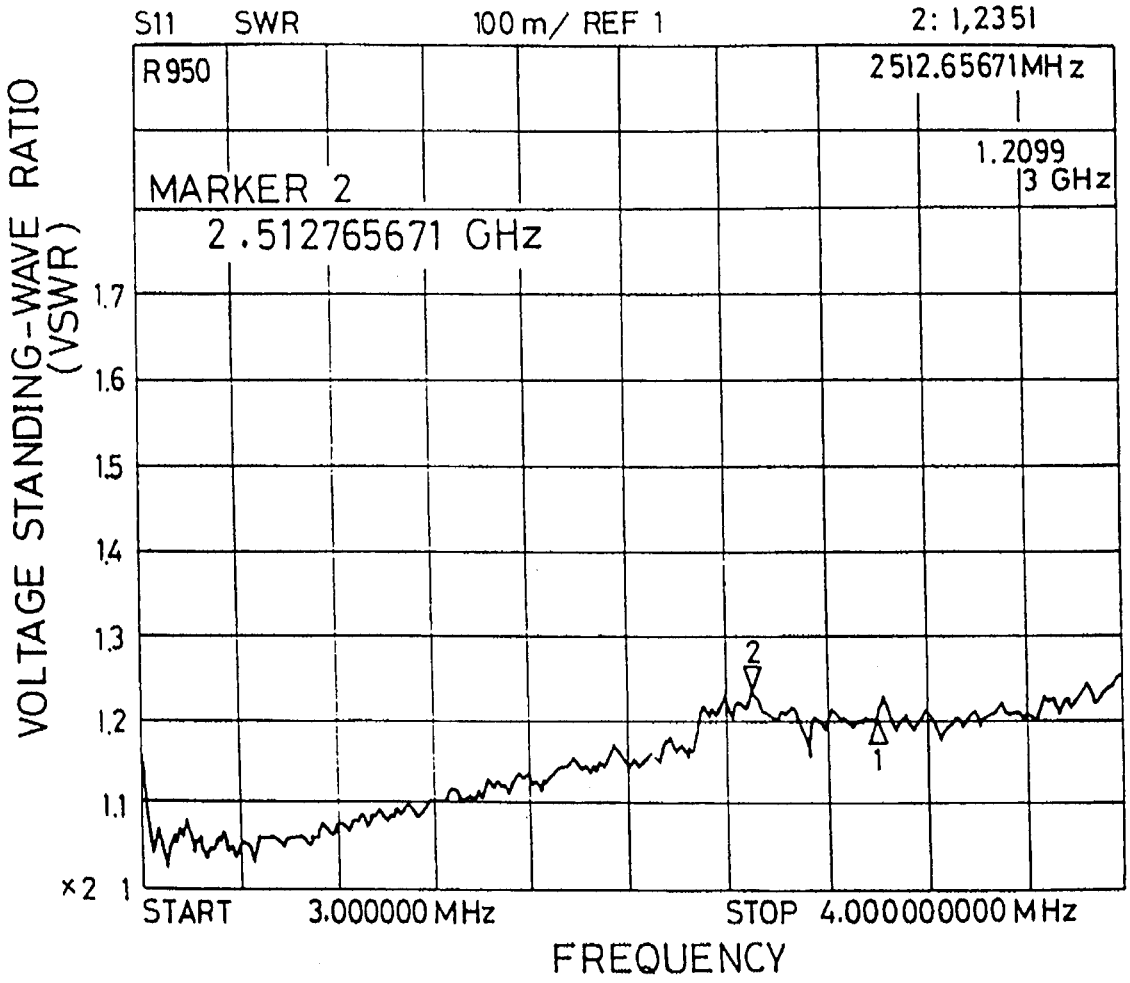
FIG. 10 is a diagram showing the voltage standing-wave ratio (VSWR) of the coaxial microstripline transducer according to the third embodiment.
Figure 11:
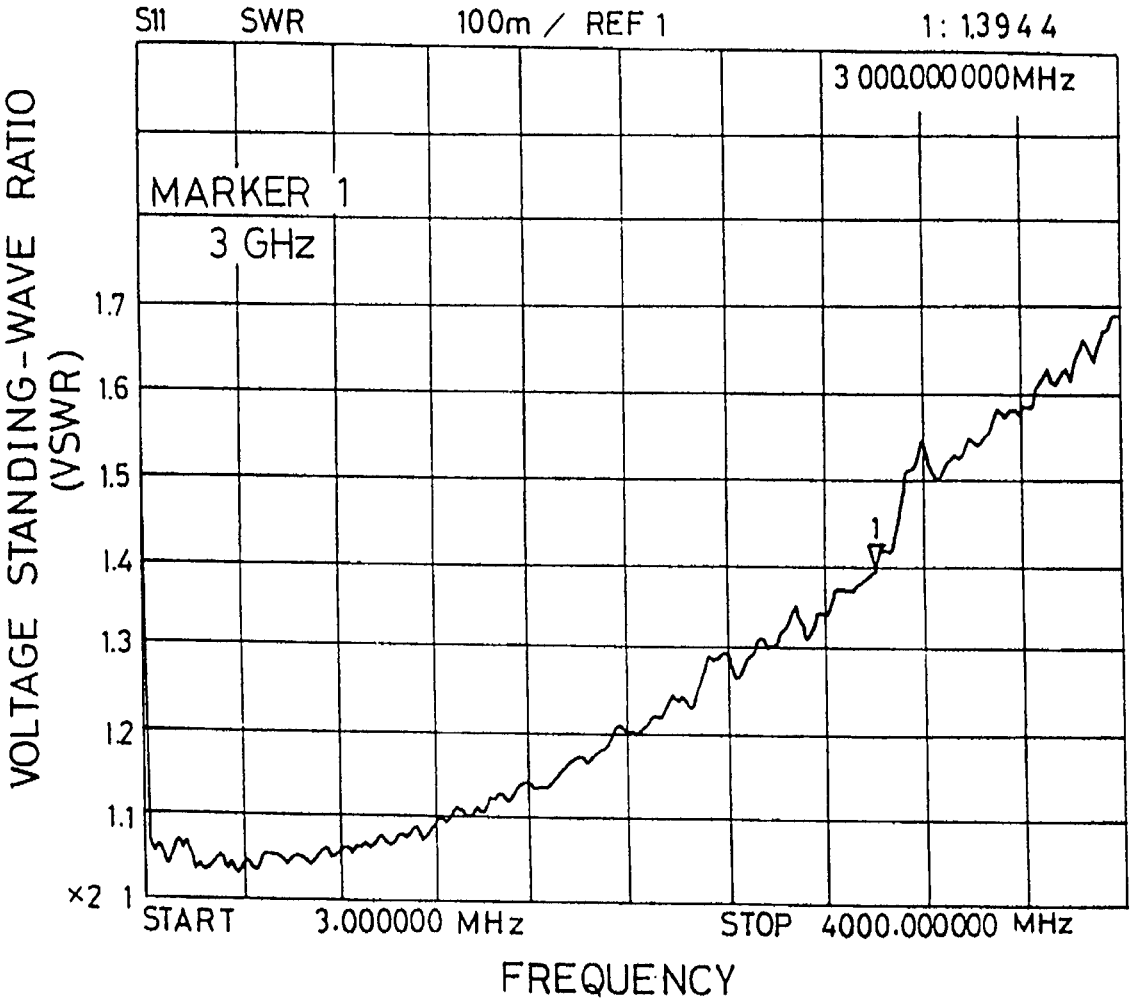
FIG.11 PRIOR ART
FIG. 11 is a diagram showing the voltage standing-wave ratio (VSWR) of a conventional coaxial microstripline transducer prepared for comparison.
Figure 12:
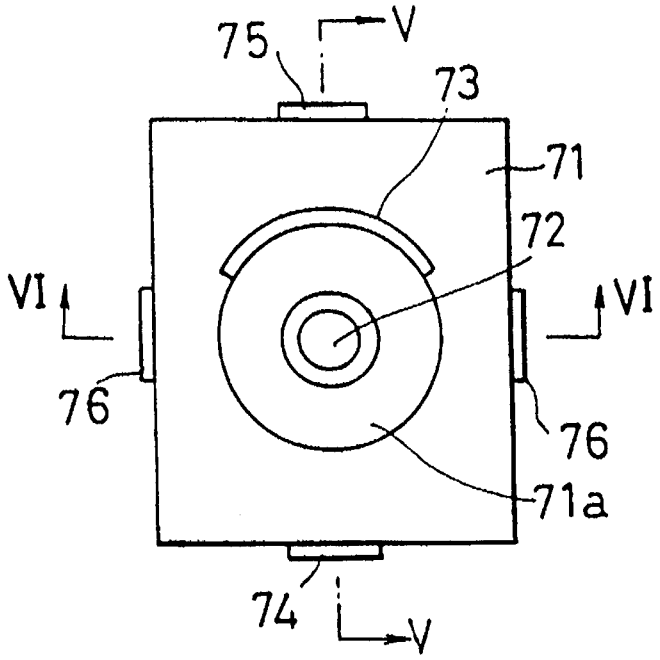
FIG.12 PRIOR ART
FIG. 12 is a plane view illustrating one example of a conventional coaxial microstripline transducer.
Figure 13:
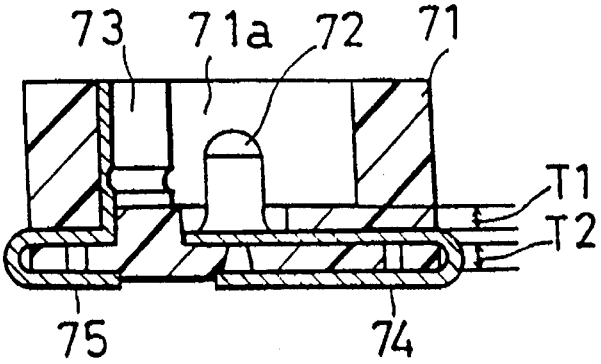
FIG13 PRIOR ART
FIG. 13 is a cross-sectional view taken along line V—V shown in FIG. 12.
Figure 14:
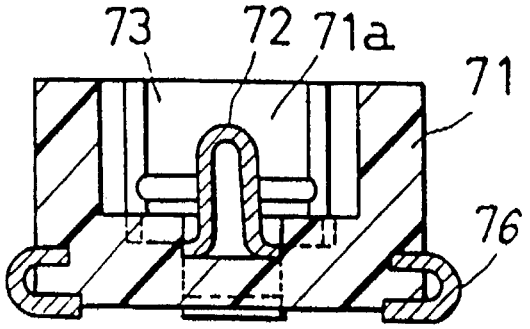
FIG.14 PRIOR ART
FIG. 14 is a cross-sectional view taken along line VI—VI shown in FIG. 12.
Figure 15:
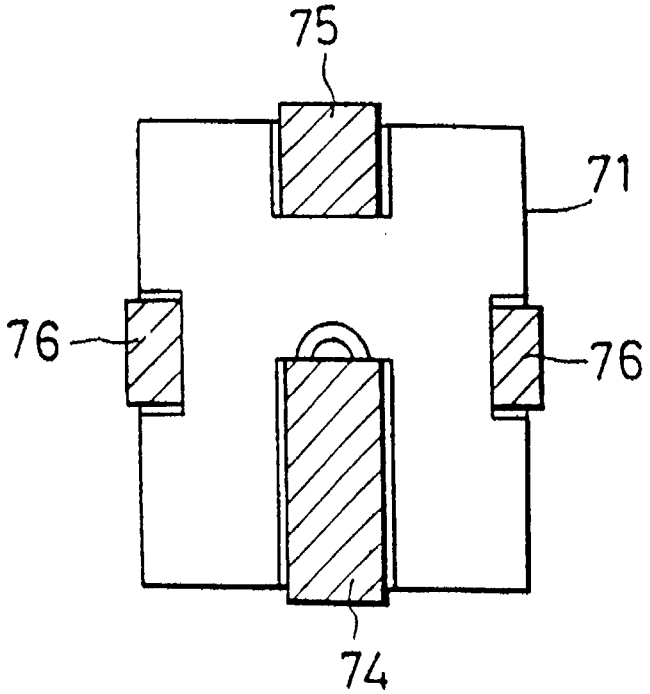
FIG15 PRIOR ART
FIG. 15 is a bottom view illustrating the conventional coaxial microstripline transducer.

FIG. 10 shows the voltage standing-wave ratio (VSWR) of the coaxial microstripline transducer 41 according to the present embodiment constructed in the above described manner, and FIG. 11 shows the voltage standing-wave ratio (VSWR) of a coaxial microstripline transducer having a corresponding structure in which no narrow portion is provided. As can be seen from the comparison between FIGS. 10 and 11, in the coaxial microstripline transducer according to the present embodiment, the voltage standing-wave ratio (VSWR) is maintained at a lower level as the operating frequency increases, so that the electrical properties are enhanced.

In any of the above embodiments of the invention, the outer conductor is advantageously made of a metal plate or sheet metal, which may have a resilient characteristic such that it tends to spring back to its original shape even after being formed into the shape of the outer conductor. The thickness of the sheet metal is about 0.1 to 0.25 mm, or preferably 0.1 to 0.12 mm for purposes of miniaturization. Because the outer conductor is made of a sheet metal material, it can easily be formed into the above-described shape, for example by machining, even though that shape is complex.

This material for the outer conductor is therefore preferable to a mere coating, such as a coating film formed by deposition. A coating film formed by plating may be only a few microns thick. A membrane formed by plating may be only a few tens of microns thick.

An advantage of using sheet metal material as a conductor is that high-frequency losses are significantly less than when a known film or membrane coating is used as a conductor, because the sheet metal is thicker.

The metal of which the sheet metal is made may be copper, copper alloy or the like. Any metal having superior electrical conductivity is suitable and the surface of the metal may be plated with any other metal such as Ni or Au. In a preferred embodiment, the metal plate is made of copper alloy (thickness=0.12 mm) and plated with Ni (thickness=1–2 μm).

If the outer conductor is resilient, the resiliency of the cylindrical portion 10*a* of the outer conductor, which is disposed within the recess portion 1*a*, permits it to expand inwardly into the recess portion 1*a* so as to grip securely a plug that is inserted into the recess. Such a resilient spring-back force cannot be obtained with an outer conductor made of a conductive film or membrane, for example.

Figure 16:
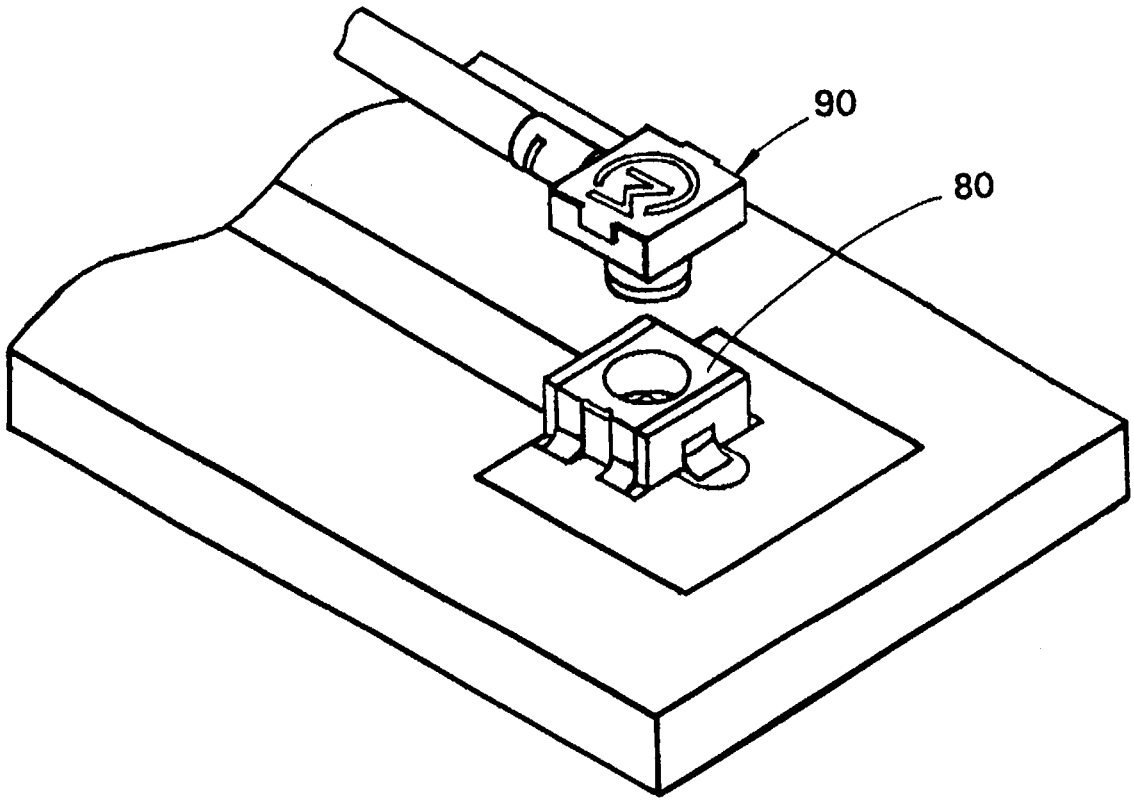
FIG. 16 is a perspective view showing a transducer according to a fourth embodiment of the invention and a plug being inserted into the transducer.

FIG. 17 shows this advantageous aspect of the invention. The cylindrical portion 80*a* of the outer conductor 80 in this embodiment is placed on the peripheral surface of the recess 1*a* which is formed in the resin case 1. The cylindrical portion 80*a* projects slightly into the recess 1*a* so as to grip by friction a plug 90 when the plug is inserted into the recess la. (See FIG. 16.)

In addition, the cylindrical portion 80*a* may have a ridge 80' which projects even further into the recess for gripping the plug. The ridge 80' may be formed by any conventional method of metal-forming, such as stamping or spinning. Correspondingly, the plug 90 may have a detent 90' formed therein for gripping the ridge 80'. FIG. 18A shows the plug 90 being inserted into the recess 1*a*, in the direction of arrow A, wherein the lower end of the plug pushes the ridge 80' and with it the inner cylindrical portion 80*a* out of the way, in the direction of arrow B, to permit the plug to pass. Then, as the detent 90' reaches the level of the ridge 80', the cylindrical portion 80*a* snaps back in the direction of arrow C with the ridge 80' engaged securely and firmly in the detent 90', as shown in FIG. 18B.

The resiliency of the outer conductor and especially the ridge and detent improve the electrical connection between the outer conductor and the plug.

Although the terms "integral with" or "formed integrally with" are used in the specification to describe an electrical connection between various conductors or electrodes, those terms are not intended to preclude the conductors or electrodes being first formed separately, and then electrically connected to each other by soldering, welding or the like. Nevertheless, in the preferred embodiments, the various portions of the electrodes are formed integrally from a single metal sheet by metal stamping, machining, or the like.

Although in the disclosed embodiments, the present invention is applied in a coaxial microstripline transducer, the present invention is not limited to the same. For example, the present invention is also applicable to, for example, a coaxial coplanar transducer.

Although embodiments of the present invention have been described and illustrated in detail, it is clearly understood that the disclosed embodiments are by way of illustration and example only and are not to be taken by way of limitation, the spirit and scope of the present invention being limited only by the terms of the appended claims.

What is claimed is:

1. A coaxial microstripline transducer comprising:

a resin case having a recess opened upwardly;

an inner conductor having a center conductor portion arranged in said recess portion and a terminal portion conductively connected to the center conductor portion and formed so as to lead to a lower surface of said resin case; and an outer conductor comprising a sheet metal plate which is shaped by machining and arranged so as to form a first conductor portion arranged along at least a part of an inner peripheral surface of said recess, and a second conductor portion integrally and conductively connected to said first conductor portion, and extending to the lower surface via an upper surface and a side surface of said resin case.

2. The coaxial microstripline transducer according to claim 1, wherein a groove in which said second conductor portion is fitted is formed on the upper surface, the side surface and the lower surface of said resin case, the depth of said groove being selected so that an outer surface of said second conductor portion does not project outward from the outer surface of said resin case when the second conductor portion is fitted into said groove.

3. The coaxial microstripline transducer according to claim 1, wherein said second conductor portion is formed integrally with said first conductor portion.

4. The coaxial microstripline transducer according to claim 1, wherein said terminal portion is formed integrally with the center conductor portion.

5. The coaxial microstripline transducer according to claim 1, wherein said second conductor portion extends to the lower surface of the resin case from the upper surface via a pair of side surfaces of said resin case which are opposed to each other.

6. The coaxial microstripline transducer according to claim 1, wherein at least one narrow portion is formed in the terminal portion of said inner conductor, having a width relatively smaller than that of another portion of said inner conductor.

7. The coaxial microstripline transducer according to claim 6, wherein a stray capacitance which is formed between said center conductor portion and said first conductor portion is balanced by an inductance which is formed by said at least one narrow portion of the terminal portion.

8. The coaxial microstripline transducer according to claim 1, wherein the first conductor portion of said outer conductor is a cylindrical conductor portion arranged along the whole inner peripheral surface of the recess portion.

9. The coaxial microstripline transducer according to claim 8, wherein said cylindrical conductor portion is a cylindrical conductor.

10. The coaxial microstripline transducer according to claim 1, wherein a through hole leading to the lower surface of the resin case is formed on a bottom surface of the recess of said resin case, the center conductor portion of said inner conductor is inserted so as to extend into the recess from said through hole, and said terminal portion is conductively connected to the center conductor portion on the lower surface of said resin case and is formed so as to lead from the lower surface of the resin case to the pair of side surfaces opposed to each other.

11. The coaxial microstripline transducer according to claim 10, wherein the width of at least a part of the second conductor portion of said outer conductor, which part is extended to the lower surface of the resin case, is larger than the width of said recess.

12. The coaxial microstripline transducer according to claim 10, wherein a groove in which said second conductor portion is fitted is formed on the upper surface, the side surface and the lower surface of said resin case, the depth of said groove being selected so that an outer surface of said second conductor portion does not project outward from the outer surface of said resin case in a case when the second conductor portion is fitted into said groove.

13. The coaxial microstripline transducer according to claim 10, wherein said terminal portion is formed integrally with the center conductor portion.

14. The coaxial microstripline transducer according to claim 8, wherein at least one narrow portion is formed in the terminal portion of said inner conductor, having a width relatively smaller than that of another portion of said inner conductor.

15. The coaxial microstripline transducer according to claim 14, wherein a stray capacitance which is formed between said center conductor portion and said first conductor portion is balanced by an inductance which is formed by said at least one narrow portion of the terminal portion.

16. The coaxial microstripline transducer according to claim 10, wherein the first conductor portion of said outer conductor is a cylindrical conductor portion arranged along the whole inner peripheral surface of the recess portion.

17. The coaxial microstripline transducer according to claim 16, wherein said cylindrical conductor portion is a cylindrical conductor.

18. The coaxial microstripline transducer according to claim 1, wherein the first conductor portion is made of a sheet metal material up to about 0.25 mm in thickness.

19. The coaxial microstripline transducer according to claim 18, wherein said sheet metal material is about 0.1- 0.12 mm in thickness.

20. The coaxial microstripline transducer according to claim 18, wherein the sheet metal material comprises copper and has a thickness of about 0.12 mm, and is plated with nickel having a thickness of about 1--2 microns.

21. The coaxial microstripline transducer according to claim 1, wherein the first conductor portion comprises resilient material and is arranged so as to project radially into the recess for resiliently and conductively engaging a plug which is inserted into the recess.

22. The coaxial microstripline transducer according to claim 21, wherein said first conductor portion further has a ridge which projects from said first conductor portion radially inward into the recess for engaging a groove in said plug.

23. A coaxial microstripline transducer comprising:

a resin case having a recess opened upwardly;

an inner conductor having a center conductor portion arranged in said recess portion and a terminal portion conductively connected to the center conductor portion and formed so as to lead to a lower surface of said resin case; and an outer conductor having a first conductor portion arranged along at least a part of an inner peripheral surface of said recess, and a second conductor portion conductively connected to said first conductor portion and extending to the lower surface via an upper surface and a side surface of said resin case;

wherein the first conductor portion comprises resilient material and is arranged so as to project radially into the recess for resiliently and conductively engaging a plug which is inserted into the recess.

24. The coaxial microstripline transducer according to claim 23, wherein said first conductor portion further has a ridge which projects from said first conductor portion radially inward into the recess for engaging a groove in said plug.

25. The coaxial microstripline transducer according to claim 23, wherein said second conductor portion extends to the lower surface of the resin case from the upper surface via a pair of side surfaces of said resin case which are opposed to each other.

* * * * *

UNITED STATES PATENT AND TRADEMARK OFFICE

CERTIFICATE OF CORRECTION

PATENT NO. : 5,525,075

DATED : June 11, 1996

INVENTOR(S) : Kenshi MICHISHITA et al.

It is certified that error appears in the above-indentified patent and that said Letters Patent is hereby corrected as shown below:

TITLE PAGE:

In section [75], change "Michisita" to --Michishita--.

Signed and Sealed this

Twenty-ninth Day of October 1996

*Attest:*

Bruce Lehman

BRUCE LEHMAN

*Attesting Officer*

*Commissioner of Patents and Trademarks*